United States Patent [19]

Koike et al.

[11] 4,374,683

[45] Feb. 22, 1983

[54] PROCESS FOR MANUFACTURING FERRITIC STAINLESS STEEL SHEET HAVING GOOD FORMABILITY, SURFACE APPEARANCE AND CORROSION RESISTANCE

[75] Inventors: Masao Koike, Nishinomiya; Yutaka Hayashi, Kobe; Masayoshi Ogaya, Joetsu, all of Japan

[73] Assignees: Sumitomo Metal Industries, Ltd., Osaka; Nippon Stainless Steel Co., Ltd., Tokyo, both of Japan

[21] Appl. No.: 237,650

[22] Filed: Feb. 24, 1981

[30] Foreign Application Priority Data

Feb. 29, 1980 [JP] Japan ..... 55-25619

[51] Int. Cl.[3] ..... C21D 8/04; C22C 38/20; C22C 38/26

[52] U.S. Cl. ..... 148/12 EA; 75/125; 75/126 F; 148/37

[58] Field of Search ..... 148/12 EA, 12 E, 37, 148/135; 75/125, 126 F

[56] References Cited

U.S. PATENT DOCUMENTS

| | | | |
|---|---|---|---|
| 3,128,211 | 4/1964 | Waxweiler | 148/12 EA |
| 3,856,515 | 12/1974 | Brandis et al. | 75/125 |
| 3,936,323 | 2/1976 | Kazeva | 148/12 EA |
| 3,957,544 | 5/1976 | Pinnow et al. | 75/125 |
| 4,286,986 | 9/1981 | Borneman | 75/125 |

FOREIGN PATENT DOCUMENTS

| | | | |
|---|---|---|---|
| 55-6086 | 2/1980 | Japan . | |
| 55-94445 | 7/1980 | Japan | 148/12 EA |
| 464655 | 9/1975 | U.S.S.R. | 75/126 F |

OTHER PUBLICATIONS

Tetsu-To-Hagane, vol. 64, No. 11, Sep. 1978, p. 262, "Effect of Ti, Nb, Zr on Formability of Low-Carbon 17 Cr Steel Sheet".

Peckner et al., *Handbook of Stainless Steels*, McGraw-Hill Book Co., 1977, pp. 20-24, 25.

*Primary Examiner*—Peter K. Skiff

*Attorney, Agent, or Firm*—Burns, Doane, Swecker and Mathis

[57] ABSTRACT

A ferritic stainless steel containing 12.00-25.00% of Cr, 0.1-2.0% of Cu and 0.2-2.0% of Nb with sulfur being restricted to not greater than 0.02%, preferably not greater than 0.005% is hot rolled with a finishing temperature of 850° C. or less, which is lower than the usual finishing temperature, and the resulting hot rolled steel strip is annealed at a relatively high temperature of 950°-1050° C. The resulting cold rolled steel sheet, though it is less expensive, possesses good formability, ridging resistance, surface appearance and corrosion resistance, and is particularly suitable for making ornamental articles, such as automotive mouldings.

7 Claims, 9 Drawing Figures x 100 x 100

PROCESS FOR MANUFACTURING FERRITIC STAINLESS STEEL SHEET HAVING GOOD FORMABILITY, SURFACE APPEARANCE AND CORROSION RESISTANCE

BACKGROUND OF THE INVENTION

This invention relates to a process for manufacturing a relatively inexpensive ferritic stainless steel sheet having good formability, surface appearance and corrosion resistance.

Stainless steel sheets have been widely used for making outer and inner panels, ornamental articles and so on in a variety of industrial fields, since the stainless steel sheets have good corrosion resistance as well as good surface appearance. Examples of these articles include outer panels of electrical appliances, kitchen utensils, building materials such as doors, knobs and wall panels, inner panels of an elevator box, transportation and automobile materials including road mirrors, automobile and train outer panels, and automotive window trims and mouldings.

A stainless steel sheet for use in such applications as listed above essentially has to possess at least the following four properties:

(1) good formability,
(2) good surface appearance,
(3) improved corrosion resistance, and
(4) inexpensiveness.

(1) Formability

The stainless steel sheet for use in said applications is in many cases formed to a final product by way of press forming. Therefore, press formability, particularly deep drawability is very important. In addition to the requirement that the material can easily be press formed, it is also very important that the sheet can be formed without causing ridging (sometimes called "roping") during forming. The ridging means the tendency to form small ridges on the surface of steel sheet during severe cold forming. The term "ridging resistance" is hereinafter used distinctively from the term "formability".

(2) Surface Appearance

When the stainless steel sheet is used as an outer or inner panel, or as an ornamental article, the surface thereof is directly exposed to the attention of the user. Therefore, the surface appearance is a very important factor in choosing a proper material. Though stainless steel has in general a smooth and lustrous surface, it sometimes contains surface defects caused by non-metallic inclusions depending on its alloy composition and its manufacturing process conditions.

The recent trend in stainless steel materials, particularly for ornamental uses or automotive window trims and mouldings is that after severe forming requirements are applied to the material, the surface appearance, and particularly surface luster, must be kept good for a long period of time. Such a good surface luster for prolonged period of time must also be accompanied by a good corrosion resistance. Thus, the combination of good surface appearance with good corrosion resistance is absolutely necessary to meet the recent trend.

In addition, a sheet surface free from streak flaws and "white-cloudy" appearance is crucial to meet the current requirements applied to ferritic stainless steel sheets. The term "streak flaws" used herein means streak-like defects on the sheet surface caused by inclusions of carbo-nitrides, oxides, etc. which have been extended in the rolling direction during rolling, and the term "white cloudy appearance" means the surface state the metallic luster of which has been lost locally or throughout during pickling due to unusual corrosion of said inclusions which have been dispersed in the sheet surface area. The surface turns to a whitish, dull color. A stainless steel sheet with such surface defects is not desirable for uses such as outer and inner building panels, and internal and external automotive components, which are required to have decorative effects.

(3) Corrosion Resistance

The material to be used in the application fields mentioned above is in general exposed to rather mild environmental conditions in comparison with the conditions to which the material for use in apparatuses in the chemical industry is exposed. However, since it is very important to keep a good surface appearance for decorative purposes, the stainless steel must withstand the surrounding atmosphere for a prolonged period of time without rusting. For example, if the material is used for automotive outer panels, it will be exposed to an atmosphere containing chlorine ions, such as a sea breeze or a salty road in winter for example, during the period of transportation from the assembly line of the factory to a customer or during its useful life. Thus, the material has to possess sufficient corrosion resistance to resist rusting in an atmosphere as would be encountered in the normal environment in which it would be used.

(4) Inexpensiveness

The material to be used in the above mentioned applications is mass-produced, and the material cost is required to be as low as possible. In general, an austenitic stainless steel is superior to ferritic stainless steel in its corrosion resistance and formability. However, since the austenitic grade steel contains a relatively large amount of nickel, an expensive element, the application thereof is limited due to its material cost. In addition, a ferritic stainless steel which contains molybdenum, which is also an expensive element, is not desirable for the same reason.

Since ferritic stainless steels, a typical one of which is the JIS SUS 430 corresponding to AISI 430, contain 16–18% of Cr and do not contain any large amounts of other expensive and special elements, the steel of this type is less expensive. However, the corrosion resistance thereof is not satisfactory. The formability thereof is also poor, and ridging during press forming cannot be prevented. In order to eliminate these disadvantages, therefore, it has been proposed to incorporate titanium, zirconium or niobium as a stabilizing element.

An article titled "The Effect of Stabilizing Elements on the Localized Corrosion of High-Purity Ferritic Stainless Steels" by T. Adachi et al, Nisshin Seiko Giho, No. 39, Dec. 1978, pp. 61–73 discloses the effect of titanium and niobium on the localized corrosion of 17Cr-steel with the total amount of carbon and nitrogen reduced to 150 ppm. U.S. Pat. No. 4,140,526 discloses that zirconium may be incorporated in a ferritic stainless steel containing 11.0–20.0% of Cr to improve the oxidation resistance as well as weldability. An article titled "Non-Roping Ferritic Chromium Steels" by. J. Thompson et al, Electric Furnace Conference Proceedings, Vol. 19, 1961 AIMI, pp. 70–88, summarizes the effects of titanium, zirconium, niobium, etc. on the resistance to ridging in ferritic stainless steels.

Thus, it is well known in the art that the reduction in contents of carbon and nitrogen and the addition of titanium, zirconium, niobium etc. are effective to improve corrosion resistance and formability and simultaneously to prevent ridging in the high purity ferritic stainless steel. These additives are used not only to fix carbon and nitrogen, but also as carbo-nitride formers to prevent the formation of texture crystal structure.

"TETSU-TO-HAGANE" Vol. 64, No. 11, Sep. 1978, p. 262 and Japanese Patent Publication No. 6086/1980 (published on Feb. 13, 1980) disclose in brief the relationship between the formation of ridges and hot rolling and hot strip annealing conditions in the Ti, Zr, or Nb-bearing stabilized steel (AISI 430). However, the disclosure is limited to the work-ability of a low carbon 17Cr-steel with the addition of Ti, Nb or Zr. These references refer to neither surface defects such as streak flaws and "white-cloudy" appearance nor corrosion resistance. Thus, they do not suggest nor teach that the stainless steel material disclosed therein can be used in applications in which a good surface appearance as well as prolonged corrosion resistance are of primary importance.

Since a ferritic stainless steel such as JIS 434 corresponding to AISI Type 434 which contains 16–18% of Cr and 0.75–1.25% of Mo possesses superior corrosion resistance to that of the JIS 430 steel corresponding to AISI 430, the 434 steel has sometimes been used for the purposes hereinbefore mentioned. However, the 434 alloy is not only more expensive because of the incorporation of Mo, an expensive element, but also the formability is inferior to that of the 430 steel and ridging occurs very easily.

For the purposes of providing a ferritic stainless steel having good formability, therefore, the addition of Ti or Zr is most commonly employed in commercial practice. However, the added Ti and Zr tend to form a large cluster of carbonitrides and oxides thereof, since titanium and zirconium have a strong affinity for carbon, nitrogen, and oxygen. This tendency is pronounced when the steel is cast by way of a continuous casting process.

According to the findings of the inventors of this invention, the final product sheet obtained from the ferritic stainless steel containing titanium or zirconium is unavoidably accompanied by surface defects such as streak flaws and "white-cloudy" appearance. Under the presently required severe specifications in the automobile industry, the sheet with such surface defects cannot be used for articles, e.g. automobile mouldings. According to the results obtained by the investigation made by the inventors of this invention, the "white-cloudy" appearance is caused by the dispersion of coarse non-metallic inclusions of carbo-nitrides and oxides of titanium or zirconium.

The inventors of this invention now found that the ferritic stainless steel with the addition of Nb is free from surface defects if the Nb-bearing steel composition as well as manufacturing process conditions are properly adjusted. The non-metallic inclusions of niobium compounds are easily and finely dispersed throughout the ferrite phase. However, as long as such a ferritic stainless steel is manufactured in accordance with the conventional manufacturing process, the resulting ferritic stainless steel will suffer from ridging accompanied by orange peel on the surface thereof when it is subjected to severe press forming. Thus proper manufacturing conditions are necessary along with the proper composition.

The inventors of this invention also found that in the Nb-bearing ferritic stainless steel the addition of copper greatly contributes to the improvement both in its formability and in its corrosion resistance.

The inventors of this invention further found the combination of niobium and copper with reduced amount of sulfur (as compared to the amount normally found in ferritic steels) can provide improved surface properties if manufacturing process conditions are properly adjusted.

Objects of the Invention

The object of this invention is to provide a new process for manufacturing a less expensive ferritic stainless steel sheet having good formability, surface appearance and corrosion resistance.

Another object of this invention is to provide a ferritic stainless steel sheet free from streak flaws and "white-cloudy" appearance.

A more specific object of this invention is to provide a new process for manufacturing a ferritic stainless steel sheet free from streak flaws and "white-cloudy" appearance, which is less expensive and is able to be used for making such articles as those now made of an expensive austenitic stainless steel because of poor formability of the conventional ferritic stainless steel, or those sometimes made of an expensive Mo-bearing ferritic grade steel (such as the 434 steel corresponding to AISI Type 434).

Summary of the Invention

Thus, this invention resides in a process for manufacturing a ferritic stainless steel sheet having good formability, surface appearance and corrosion resistance, comprising the steps of: hot rolling a steel composition which consists essentially of:

C: not greater than 0.02%
Si: not greater than 1.0%
Mn: not greater than 1.0%
P: not greater than 0.04%
S: not greater than 0.02%
Cr: 12.00–25.00%
Cu: 0.1–2.0%
Nb: 0.2–2.0% the balance iron with incidental impurities, with a finishing temperature of 850° C. or less, annealing the resulting hot rolled steel strip at a temperature of 950° C.–1050° C., and then carrying out cold rolling and recrystallization annealing.

Preferably, this invention resides in a process for manufacturing a ferritic stainless steel sheet having good formability, surface appearance and corrosion resistance, comprising the steps of: hot rolling a steel composition which consists essentially of:

C: not greater than 0.02%
Si: 0.01–1.0%
Mn: 0.01–1.0%
P: not greater than 0.04%
S: not greater than 0.005%
N: not greater than 0.02%
Cr: 15–25%
Cu: 0.3–1.0%
Nb: 0.3–0.8% the balance iron with incidental impurities, with a finishing temperature of 850° C. or less, preferably 780° C.

or less, annealing the resulting hot rolled steel strip at a temperature of 950°-1050° C., and then carrying out cold rolling and recrystallization annealing.

DETAILED DESCRIPTION OF THE INVENTION

As already mentioned, this invention is based on the findings that the combination of a specific steel composition with specific manufacturing process conditions can results in a steel sheet having good formability and a markedly improved surface appearance accompanied by a satisfactory resistance to corrosion. The improvement can be obtained without addition of any expensive alloying elements.

The reasons for limiting the starting steel composition to the limits set forth in this invention are as follows. Since it is necessary to provide the steel sheet with good surface appearance, the addition of titanium or zirconium, which cause streak flaws and "white cloudy" appearance, should be avoided. The problems resulting from the exclusion of these usual alloying elements, i.e. the deterioration of corrosion resistance, formability and ridging resistance, can be compensated for not only by the addition of copper and niobium and the reduction of the amounts of carbon, nitrogen and sulfur, but also by employing specified manufacturing process conditions.

The lower the carbon content, the more the corrosion resistance and formability are improved. According to this invention, the carbon content is restricted to not greater than 0.02%. For the same reason, the smaller the nitrogen (N) amount the better. In a preferred embodiment of this invention the nitrogen is limited to not greater than 0.02%.

Figure 1:
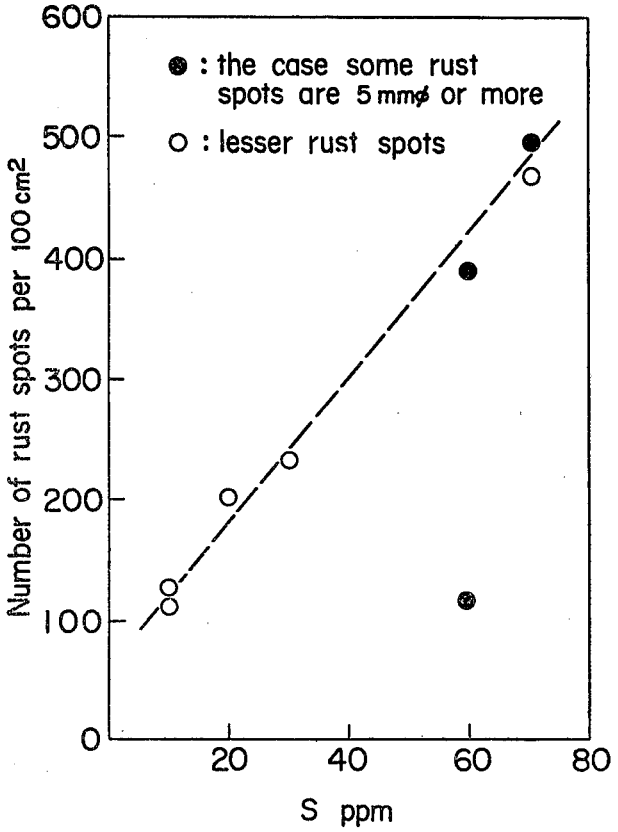
FIG. 1 is a graph showing the effect of sulfur content on the resistance to corrosion.
Figure 2:
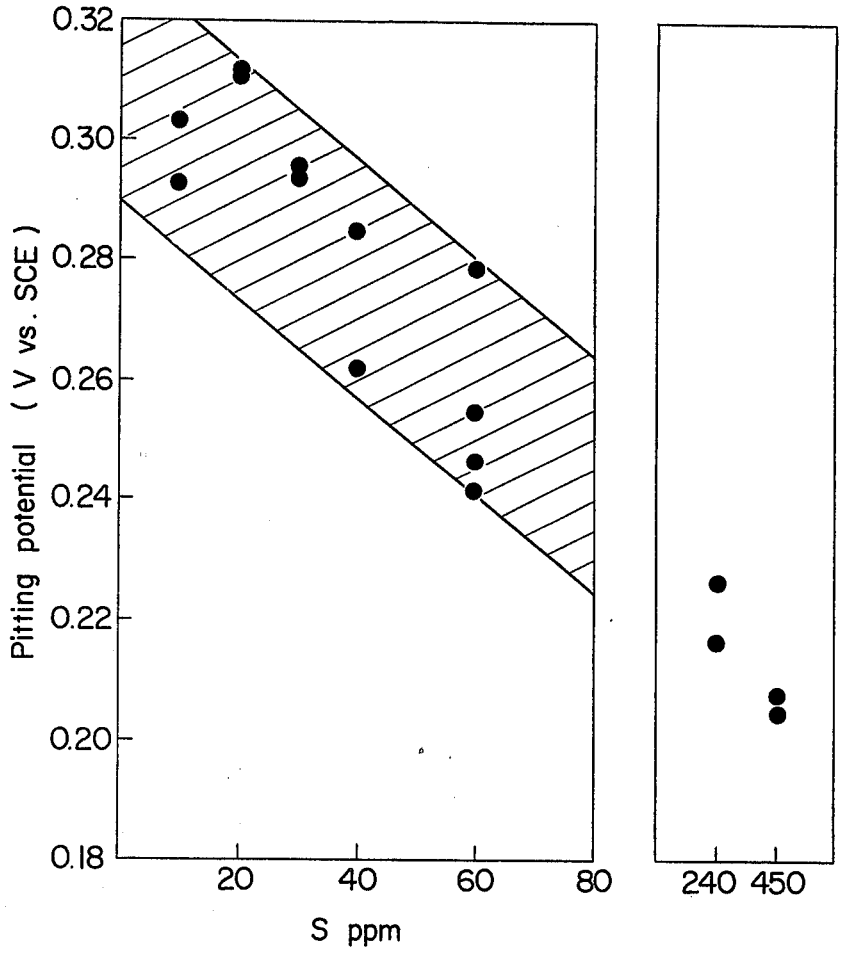
FIG. 2 is a graph showing the effect of sulfur content on pitting potential.
Figure 3:
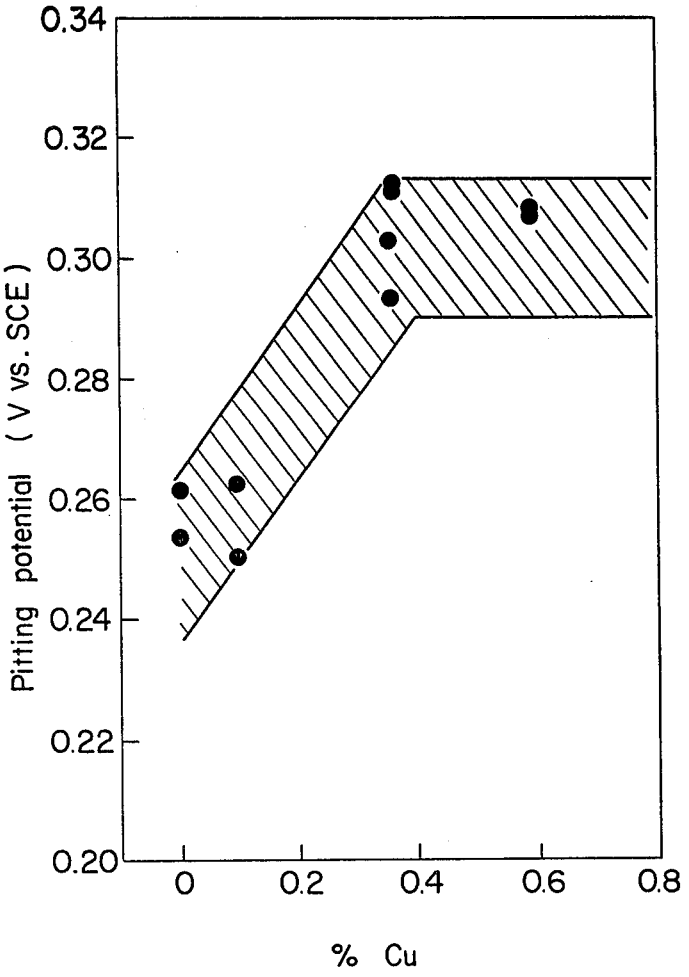
FIG. 3 is a graph showing the effect of copper content on pitting potential.

FIGS. 1-3 show the effects derived from the variation in sulfur and copper contents with respect to corrosion. The data shown in FIGS. 1-3 were obtained by experiments utilizing process conditions of this invention (described in more detail hereinafter) wherein 3 mm thick hot rolled steel sheets (hot rolling finishing temperature: 780° C.) having the basic chemical composition shown in Table 1 below were used as testing samples after annealing at a temperature of 1000° C. for 20 minutes in an argon atmosphere and air cooling.

TABLE 1

| C | Si | Mn | P | S | Cu | Cr | Nb | N | (wt %) |
|---|---|---|---|---|---|---|---|---|---|
| 0.01 | 0.06 | 0.50 | 0.02 | 0.003 | 0.40 | 17.3 | 0.40 | 0.02 | |

FIG. 1 shows the results of the 400-cycle repeated dry-wet test (dipping for 25 minutes and drying for 5 minutes) with 5% NaCl solution at 50° C. In FIG. 1, samples showing rust with red-colored spots having diameters of 5 mm or more are indicated by the mark "•" while samples showing rust with red-colored spots of lesser diameters are indicated by "o". As is apparent from the graph, the number of visual rust spots decreases with a decrease in the sulfur content. Particularly, when the sulfur content is 0.005% or less, the generation of large-sized red-colored rust spots 5 mm or more in diameter is completely eliminated. FIG. 2 is the graph of pitting potential plotted against sulfur content. Pitting potential values were measured with a 0.01 M NaCl solution at 60° C. The results shown in FIG. 2 shows that the pitting potential increases with a decrease in the sulfur content. That is, the resistance to corrosion is improved with a decrease in the sulfur content. Thus, according to this invention, the presence of sulfur is restricted to not greater than 0.02%, preferably not greater than 0.005%

FIG. 3 shows pitting potential measured using 0.01 M NaCl solution at 60° C. with respect to the copper content. As is apparent from the data shown in the graph, the pitting potential increases as the copper content increases. In particular, when the proportion of copper is 0.30%, preferably 0.35% or more, the pitting potential is distinctively higher than that when the copper proportion is less than 0.10%.

Niobium (Nb) stabilizes carbon and nitrogen in the steel, preventing the deterioration of corrosion resistance. The addition of niobium is also effective to improve the resistance to ridging. Niobium is present in the present invention in an amount of 0.2-2.0%. Since an intermetallic compound of the Laves phase ($Fe_2Nb$) is sometimes formed when the amount of niobium is in the upper side within said range, the niobium content is preferably 0.3-0.8%.

Silicon (Si) is added as a deoxidizing agent. However, when the proportion of silicon is over 1.0%, the ductility deteriorates, impairing the formability.

Manganese (Mn) is added as a deoxidizing agent and also as an element to improve the hot workability of the stainless steel. However, when the manganese is over 1.0%, the resulting steel hardens so much that the workability is affected adversely.

Since phosphorus (P) is an impurity, the amount thereof should preferably be as small as possible. An amount of phosphorus of up to 0.04% is allowable. When the phosphorus exceeds 0.04%, its adverse effect on formability is remarkable.

Chromium (Cr) in an amount of 12% or more is necessary to secure the corrosion resistance required for stainless steel. The higher the chromium content the more the corrosion resistance is improved. However, when the chromium content is over 25%, the brittleness becomes remarkable, making cold working difficult. On the other hand, as a less expensive steel to be used in place of the JIS SUS 434 (AISI 434), the chromium content is desirably restricted to not less than 15%. When the chromium content is within the range of from 12% to 25%, preferably from 15% to 25%, according to this invention it is possible to maintain the corrosion resistance comparable or superior to that of JIS SUS 434 (AISI 434) and some austenitic grade stainless steels without the addition of Mo.

Thus, a steel sheet free from such surface defects as usually found in Ti-, or Zr-bearing stainless steels can be obtained by defining the steel composition as in the above. However, it is to be noted that even the steel composition defined above would usually result in ridging during press forming, if the conventional process for manufacturing a steel sheet was applied. Thus, according to this invention, the following conditions are also required so as to prevent ridging and to obtain superior formability. That is, the steel composition as defined above should be hot rolled with a finishing temperature of not higher than 850° C., preferably not higher than 780° C., which is relatively lower than the usual finishing temperature, and the resulting hot rolled steel strip should be annealed at a temperature of 950°-1050° C. prior to cold rolling.

The reduction in the hot rolling as well as the annealing time in the annealing of the hot rolled steel strip are not critical. These parameters may be selected from the ranges conventionally employed in the art.

According to this invention it is possible to mass-produce a ferritic stainless steel sheet provided with improved resistance to ridging and good surface appearance accompanied by improved corrosion resistance. In addition, since the process of this invention only requires the change in the temperature conditions of the conventional process, the commercial application of this invention process do not require any complicated modifications or additional equipment to the conventional commercial production line. Furthermore, the process of this invention can be applied not only to the slab obtained by way of an ingot making process, but to the slab obtained by way of a continuous casting process with satisfactory results. This is another advantage of this invention, because the latter slab has in general been thought to have degraded properties.

The reasons for defining the manufacturing process conditions as in the above are as follows.

Since it is conventional to hot roll immediately after soaking, which is carried out at a temperature of about 1200° C., the conventional finishing temmperature is usually 880°-920° C. According to the findings of the inventors of this invention, however, the temperature conditions, particularly the hot rolling temperature conditions are very important in case of the Nb-containing ferritic stainless steel. The lower the finishing temperature the higher the resistance to ridging, and the lower the finishing temperature the more the formability is improved. Although the exact mechanism by which this invention occurs is not known, it is believed as follows. The remaining strain which serves as nuclei for recrystallization upon annealing increases as the finishing temperature decreases. In addition, at low finishing temperatures, carbo-nitrides of niobium which inherently form are finely dispersed throughout the matrix, and the finely dispersed carbo-nitrides of niobium can successfully prevent the crystal growth upon recrystallization. Therefore, the formation of coarse grains is prevented with improvement in the resistance to ridging and in the formability. Preventing the formation of coarse grains also serves to improve surface appearance. In order to lower the finishing temperature, it is desirable to reduce the soaking temperature itself.

Regarding the annealing conditions of the hot rolled steel strip, the inventors of this invention found that the effect having been obtained by reducing the finishing temperature can be maximized when the annealing is conducted at a temperature of 900° C. or higher. The reasons why the temperature of 900° C. or higher is preferable can be explained as follows. That is, the annealing step prior to cold rolling is conducted to accelerate the progress of recrystallization so as to make the orientation of crystal grains disperse at random and to make the recrystallized grains as fine as possible. This step, therefore, is effective for preventing the formation of ridging which is supposed to be caused by the presence of unidirectionally-oriented coarse crystal grains. This effect of preventing the formation of ridging is distinctive only when the annealing temperature is 900° C. or higher.

Thus, according to this invention, the random dispersion of fine recrystallized grains is accelerated by employing the combination of specific steel composition with specific manufacturing process conditions, resulting in a steel sheet free from not only ridging, but streak flaws and "white-cloudy" surface appearance.

This invention will be further explained by way of working examples, which are presented merely for the illustration of this invention and are not intended to limit this invention in any way.

EXAMPLE 1

A steel having an alloy composition shown in Table 2 below was worked through the steps shown in Table 3 below to provide a cold rolled steel sheet. A quantitative relation between the finishing temperature for hot working or the annealing temperature for hot rolled strip and the ridging resistance and formability was experimentally determined on the cold rolled sheet in terms of ridge formation, r-value and elongation. The ridge formation was visually determined on the sheet surface after stretching 20% in tension, and the degree thereof was estimated by classifying the ridge height into the following eight grades:

| | | | |
|---|---|---|---|
| A: | ≦10μ, | A': | 11-15μ |
| B: | 16-25μ, | B': | 26-30μ |
| C: | 30-50μ, | C': | 51-60μ |
| D: | 60-80μ, | D': | >80μ |

TABLE 2

| C | Si | Mn | P | S | Cr | Cu | Nb | N | (wt %) |
|---|---|---|---|---|---|---|---|---|---|
| 0.012 | 0.59 | 0.51 | 0.021 | 0.013 | 17.18 | 0.40 | 0.44 | 0.010 | |

TABLE 3

| Step | | |
|---|---|---|
| Step 1 | preparation of the melt: | 17 Kg in vacuum |
| Step 2 | forging: | thickness from 100 mm (ingot) to 25 mm (slab) |
| Step 3 | hot rolling: | thickness from 25 mm to 4 mm (six passes) finishing temperature of 680° C.-900° C. |
| Step 4 | annealing of hot rolled: steel strip | heating at 900-1100° C. for one minute and then air cooling |
| Step 5 | cold rolling: | Thickness from 4 mm to 0.8 mm |
| Step 6 | finishing annealing: | heating at 950° C. for one minute and then air cooling |

Figure 4:
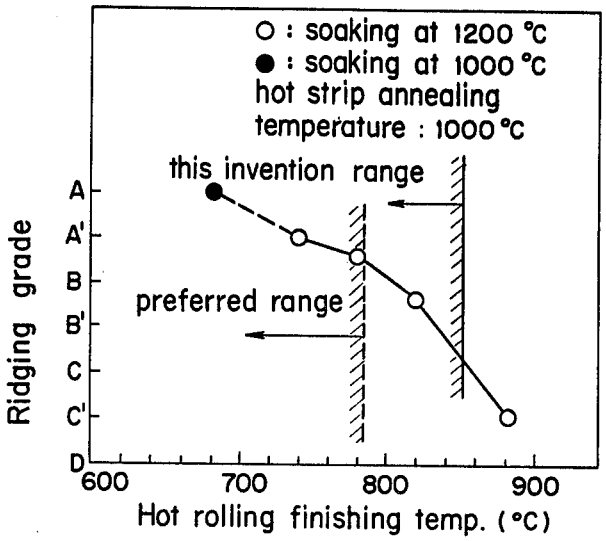
FIG. 4 is a graph illustrating the relation between finishing temperature of hot rolling and the resistance to ridging.
Figure 5:
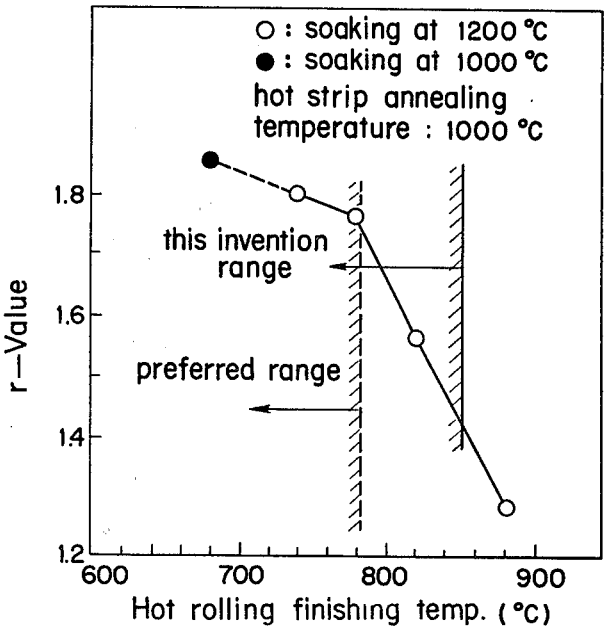
FIG. 5 is a graph illustrating the relation between finishing temperature of hot rolling and r-values.
Figure 6:
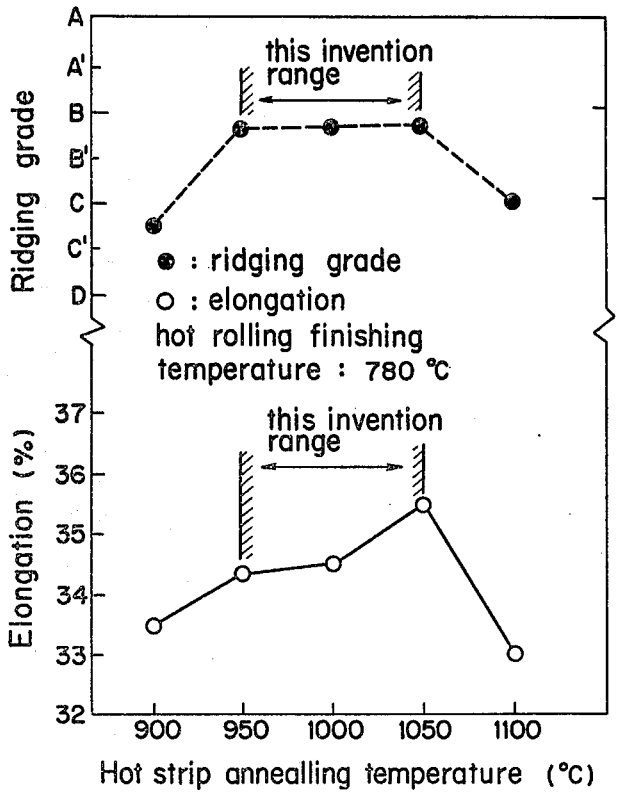
FIG. 6 is a graph showing the relation between annealing temperatures for hot rolled steel strip and the resistance to ridging and elongation.

The results are summarized in FIGS. 4, 5 and 6.

As is apparent from FIGS. 4 and 5, ridge formation is reduced and the r-value increased as the finishing temperature decreases. This tendency is also found with respect to CCV (conical cup test values) and Erichsen-values. According to this invention, the finishing temperature is restricted to not higher than 850° C. so that products with a ridging grade of B' or higher and a r-value of greater than 1.4 can be obtained. Steel sheet having these properties (or better) can withstand extremely severe forming as is found in making automotive mouldings and other products such as described above. As is also apparent from FIGS. 4 and 5, when the finishing temperature is not higher than 780° C., both the resistance to ridging and drawability are improved even more and this maximum finishing temperature is thus preferred.

Furthermore, according to this invention, the annealing temperature for the annealing step after hot rolling is defined as 950°–1050° C., and within this range, as shown in FIG. 6, the resistance to ridging in the grade B' or higher and an elongation of 34% or higher can be obtained. The resistance to ridging is below the desired B' range and the elongation is below about 34% even for steel hot rolled at a finishing temperature of 780° C. when annealing temperatures outside the defined range are used as shown in FIG. 6.

Figure 7:
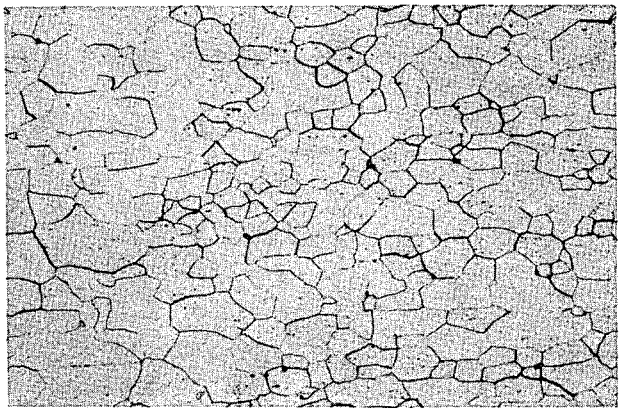
FIG. 7 is a microstructure (×100) of the steel sheet of this invention.
Figure 8:
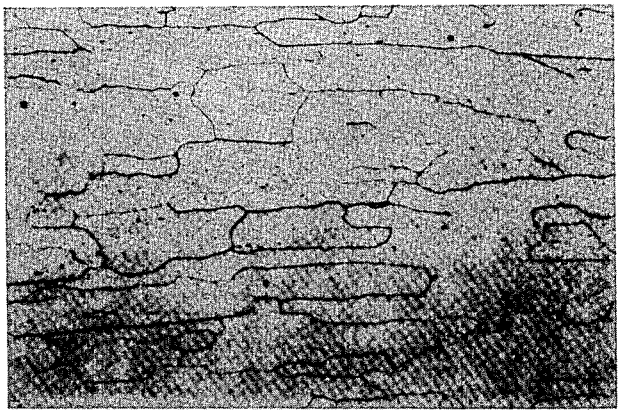
FIG. 8 is a microstructure (×100) of a comparative steel sheet.

FIG. 7 is a microstructure (×100) of the steel sheet obtained in this Example. The finishing temperature was 780° C. and the annealing was conducted at a temperature of 1000° C. for one minute prior to the cold rolling. For comparison purposes a microstructure (×100) of a steel sheet made of the same steel but processed outside the conditions of this invention is shown in FIG. 8. In the latter case, the finishing temperature was 900° C. and the annealing was carried out at a temperature of 900° C. for one minute. It is apparent that the recrystallized crystal grains of FIG. 7 are markedly finer as compared with those of FIG. 8.

EXAMPLE 2

Factory-produced steel sheets having the chemical composition shown in Table 4 below were tested with respect to press formability, corrosion resistance and surface appearance. Steel A in the Table 4 is a steel of this invention while Steels B and C are typical ferritic stainless steels.

TABLE 4

| Mark | Steel type | Chemical Composition (wt %) C | Si | Mn | P | S | Cr | Cu | Nb | N | Mo |
|---|---|---|---|---|---|---|---|---|---|---|---|
| A | this invention | 0.015 | 0.45 | 0.53 | 0.025 | 0.001 | 16.5 | 0.40 | 0.55 | 0.017 | — |
| B | comparative steel* | 0.05 | 0.48 | 0.59 | 0.025 | 0.002 | 16.2 | — | — | 0.022 | — |
| C | comparative steel* | 0.05 | 0.48 | 0.58 | 0.026 | 0.002 | 16.3 | — | — | 0.021 | 1.1 |

*The comparative steels B and C correspond to AISI 430 and 434, respectively, except that the sulfur contents in these steels are specially reduced.

These steels were melted with an 80 ton converter and after AOD refining were continuously cast into slabs 180 mm thick. The resulting slabs were hot rolled after soaking at a temperature of 1200° C. to provide steel sheets 5.0 mm thick. After air cooling to room temperature, annealing was applied under conditions shown in Table 5 below. The annealed sheets were then cold rolled to a thickness of 0.4 mm, and were subjected to a finishing annealing. Part of the "A" sample was processed according to the same conditions as the B and C samples and is identified below as "A-2". The other portion which was processed according to the conditions of the present invention is identified as "A-1". Formability, ridging grade and corrosion resistance were determined on these steel sheets. The manufacturing process conditions and the test results are summarized in Table 5.

TABLE 5

| Steel sheet | Manufacturing process conditions: Hot rolling finishing temperature (°C.) | Hot strip annealing conditions | Cold strip annealing conditions | Formability: Y.P. (Kg/mm²) | T.S. (Kg/mm²) | El (%) | $\bar{r}$ | $\bar{n}$ | CCV (%, 36ϕ) | Er (mm) | λ (%) | Ridging grade (20% strain) | Corrosion resistance: Pitting potential (0.01 M NaCl aq. at 60° C.) |
|---|---|---|---|---|---|---|---|---|---|---|---|---|---|
| A-1 | 780 | 1000° C. × 1 min. air cooled | 950° C. × 1 min. air cooled | 34.9 | 53.2 | 30.3 | 1.96 | 0.18 | 27.7 | 9.65 | 89.3 | B | 0.24 V vs SCE |
| A-2 | 880 | 850° C. × 16 hr. gradually cooled | 830° C. × 1 min. air cooled | 35.2 | 54.0 | 28.5 | 1.40 | 0.17 | 28.0 | 9.55 | 65.0 | C' | 0.23 V vs SCE |
| B | 880 | 850° C. × 16 hr. gradually cooled | 830° C. × 1 min. air cooled | 40.2 | 58.6 | 26.8 | 1.18 | 0.16 | 28.8 | 9.49 | 45.0 | B | 0.16 V vs SCE |
| C | 880 | 850° C. × 16 hr. gradually cooled | 830° C. × 1 min. air cooled | 41.0 | 59.1 | 25.5 | 1.10 | 0.16 | 28.7 | 9.30 | 43.0 | C | 0.23 V vs SCE |

As is apparent from the data shown in Table 5 above, the resistance to corrosion of this invention steel sheet is superior to that of AISI 430 and is comparable to that of AISI 434. The steel sheet of this invention (A-1) possesses improved formability in every item, and particularly with respect to El, $\bar{r}$ and $\lambda$. The Steel Sheet A-2, the chemical composition of which is the same as that of this invention but which is manufactured using process conditions which fall outside those of this invention, is much inferior to the Steel Sheet A-1 with respect to these formability items, particularly with respect to the resistance to ridging. Using the Steel Sheet A-1 actual automotive mouldings were press formed. The resulting articles were free from ridging, streak flaws, and "white-cloudy" surface appearance.

Figure 9:
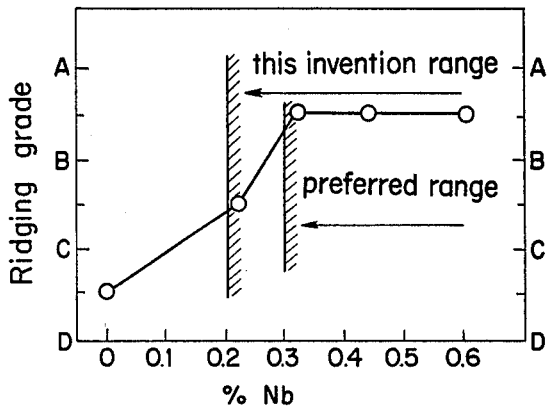
FIG. 9 is a graph illustrating the relation between niobium content and the resistance to ridging.

The effect of the variation in niobium content on the resistance to ridging was determined by using Steel A in Table 4 as the basic composition and varying the niobium content from zero to 0.62%. The manufacturing process conditions were the same as those of Steel Sheet A-1 of Table 5. The results are shown in FIG. 9. As is apparent from the data shown therein, the resistance to ridging is satisfactorily improved when the niobium content is not less than 0.2%, preferably not less than 0.3%.

Thus, according to this invention, a steel sheet having the following properties can be obtained:

(1) the resistance to corrosion comparable to that of stainless steels containing 16–18% of Cr as well as to that of AISI 434;

(2) formability superior to not only that of AISI 430 but also that of Ti-, or Zr-bearing ferritic stainless steel;

(3) surface appearance free from ridging and surface defects; and (4) a relatively low material cost and manufacturing cost.

The stainless steel sheet of this invention is suitable for wide use for making articles which are formed by severe press forming and required to have good surface appearance even after the severe forming. In addition, this invention stainless steel sheet may be used in place of an expensive austenitic grade steel sheet and Mo-bearing ferritic stainless steel sheet. Therefore, the value of this invention from an industrial viewpoint is thought to be great.

What is claimed is:

1. A process for manufacturing a ferritic stainless steel sheet having good formability, surface appearance and corrosion resistance, comprising the steps of: hot rolling a steel composition which consists essentially of:

C: not greater than 0.02%
Si: not greater than 1.0%
Mn: not greater than 1.0%
P: not greater than 0.04%
S: not greater than 0.005%
Cr: 12.00–25.00%
Cu: 0.1–2.0%
Nb: 0.2–2.0% the balance Fe with incidental impurities with a finishing temperature of 850° C. or less, annealing the resulting hot rolled steel strip at a temperature of 950° C.–1050° C., and then carrying out cold rolling and recrystallization annealing.

2. The process defined in claim 1, wherein Nb is 0.3–0.8%.

3. The process defined in claim 1, wherein Cu is 0.3–1.0%.

4. A process for manufacturing a ferritic stainless steel sheet having good formability, surface appearance and corrosion resistance, comprising the steps of: hot rolling a steel composition which consists essentially of:

C: not greater than 0.02%
Si: 0.01–1.0%
Mn: 0.01–1.0%
P: not greater than 0.04%
S: not greater than 0.005%
N: not greater than 0.02%
Cr: 15–25%
Cu: 0.3–1.0%
Nb: 0.3–0.8% the balance iron with incidental impurities, with a finishing temperature of 850° C. or less, annealing the resulting hot rolled steel strip at a temperature of 950° C.–1050° C., and then carrying out cold rolling and recrystallization annealing.

5. The process defined in claim 4, wherein the finishing temperature is 780° C. or less.

6. The process defined in any of claims 4 and 5, wherein the resulting hot rolled steel strip is subjected to annealing after being cooled to room temperature prior to cold rolling.

7. The product of the process of claim 1 or 4.

* * * * *